US011142847B2

(12) United States Patent
Kotera et al.

(10) Patent No.: US 11,142,847 B2
(45) Date of Patent: Oct. 12, 2021

(54) SPINNING NOZZLE, PROCESS FOR PRODUCING FIBROUS MASS, FIBROUS MASS, AND PAPER

(71) Applicant: Mitsubishi Chemical Corporation, Tokyo (JP)

(72) Inventors: Yoshinobu Kotera, Chiyoda-ku (JP); Yukio Onohara, Otake (JP); Shima Nakanishi, Otake (JP)

(73) Assignee: Mitsubishi Chemical Corporation, Tokyo (JP)

( * ) Notice: Subject to any disclaimer, the term of this patent is extended or adjusted under 35 U.S.C. 154(b) by 142 days.

(21) Appl. No.: 15/801,080

(22) Filed: Nov. 1, 2017

(65) Prior Publication Data

US 2018/0051391 A1 Feb. 22, 2018

Related U.S. Application Data

(62) Division of application No. 14/768,828, filed as application No. PCT/JP2014/054696 on Feb. 26, 2014, now Pat. No. 9,834,864.

(30) Foreign Application Priority Data

Feb. 26, 2013 (JP) ..... JP2013-035964

(51) Int. Cl.

| | |
|---|---|
| ***D21H 13/18*** | (2006.01) |
| ***D01F 6/18*** | (2006.01) |
| ***D01D 5/06*** | (2006.01) |
| ***D01D 4/02*** | (2006.01) |

(52) U.S. Cl.

CPC ..... *D01D 5/06* (2013.01); *D01D 4/02* (2013.01); *D01F 6/18* (2013.01); *D21H 13/18* (2013.01)

(58) Field of Classification Search

CPC ... D01D 5/06; D01D 4/02; D01F 6/18; D21H 13/18; D21H 13/00; Y10T 442/60

See application file for complete search history.

(56) References Cited

U.S. PATENT DOCUMENTS 3,932,687 A * 1/1976 Okamoto ..... D04H 1/58 442/334
4,355,075 A * 10/1982 Norota ..... D01D 5/20 428/369

(Continued)

FOREIGN PATENT DOCUMENTS

JP 51 119826 10/1976
JP 53 122815 10/1978

(Continued)

OTHER PUBLICATIONS

International Search Report dated May 20, 2014 in PCT/JP14/054696 Filed Feb. 26, 2014.

(Continued)

*Primary Examiner* — Jennifer A Steele
(74) *Attorney, Agent, or Firm* — Oblon, McClelland, Maier & Neustadt, L.L.P.

(57) ABSTRACT

A spinning nozzle which has a perforated part in which ejection holes have been arranged in a density as high as 600-1,200 holes/mm$^2$. This process for producing a fibrous bundle comprises ejecting a spinning dope having a viscosity as measured at 50° C. of 30-200 P from the ejection holes of the spinning nozzle to produce a fibrous bundle. This fibrous bundle has a single-fiber fineness of 0.005-0.01 dtex. By the wet-process direct spinning, a mass of nanofibers which are stably uniform and continuous can be produced at a high efficiency.

8 Claims, 3 Drawing Sheets

(56) References Cited

U.S. PATENT DOCUMENTS

| | | | | |
|---|---|---|---|---|
| 4,705,605 | A | 11/1987 | Becker et al. | |
| 2007/0196401 | A1* | 8/2007 | Naruse | A61K 8/027 424/401 |
| 2007/0207693 | A1* | 9/2007 | Tsukuda | H01G 9/02 442/381 |
| 2007/0218279 | A1* | 9/2007 | Nonaka | B24B 37/24 428/365 |
| 2010/0136312 | A1* | 6/2010 | Inagaki | D01F 8/14 428/219 |
| 2015/0167249 | A1* | 6/2015 | Ono | D21H 13/14 162/130 |

FOREIGN PATENT DOCUMENTS

| | | | |
|---|---|---|---|
| JP | 58 7760 | | 1/1983 |
| JP | 62 21810 | | 1/1987 |
| JP | 3 206114 | | 9/1991 |
| JP | 7 39061 | | 5/1995 |
| JP | 2000 328347 | | 11/2000 |
| JP | 2001 200420 | | 7/2001 |
| JP | 2008115478 | * | 5/2008 |
| JP | 2012 72519 | | 4/2012 |

OTHER PUBLICATIONS

Hiroshi Hosokawa, "Society of Fiber Science and Technology", Japan Sen'l Gakkaishi (Journal of SFSTJ),1998, vol. 54, No. 3, 10 pages (with Partial English Translation).

* cited by examiner

SPINNING NOZZLE, PROCESS FOR PRODUCING FIBROUS MASS, FIBROUS MASS, AND PAPER

CROSS REFERENCE TO RELATED APPLICATION

This application is a divisional of U.S. patent application Ser. No. 14/768,828, filed on Aug. 19, 2015, which is a 35 U.S.C. § 371 national stage patent application of international patent application PCT/JP2014/054696, filed on Feb. 26, 2014, which claims priority to Japanese patent application JP 2013-035964, filed on Feb. 26, 2013.

TECHNICAL FIELD

The present invention relates to a spinning nozzle made by suitably arranging ejection holes so that a coagulation liquid uniformly infiltrates all of the ejection holes in a super-porous nozzle arranging small diameter ejection holes in high density for the production of ultrafine fibers; a process for producing uniform micro fibers having a single-fiber fineness of nano (sub-micron) order using this spinning nozzle; and a fibrous bundle and paper obtained from this production process.

BACKGROUND ART

Synthetic fibers are mainly used in clothing applications, and many considerations have come to be actively made for polymer modification, modifying cross sections, imparting functionality, increasing fineness, and the like in order to improve the performance and texture thereof. In particular, the increased fineness of single fibers has led to the progression of suede-tone artificial leather from the development of micro fibers, and this basic technology thereof is employed in life materials such as wiping cloths and industrial material applications like filters, and thus currently, further increases in fineness are continuing. Nowadays in particular, the use of nanofiber nonwoven fabric is being actively considered in secondary battery separators equipped to hybrid vehicles and electric cars, filters with improved high functionality, etc.

The size of the fine holes in a fibrous bundle such as non-woven fabric is said to be greatly influenced by the diameter of the single fibers constituting the fibrous bundle. In other words, in order to make smaller fine holes to form, it is necessary to form a non-woven fabric with smaller fibers in fiber diameter. However, with conventional spinning methods based on melt spinning, wet spinning, etc., about 2 μm is the limit to thinning the fiber diameter, and it has not been at a level that adequately responds to the needs for nanofibers.

As one of the production technologies of nanofibers, the phase-separation method has been known industrially. This is a technology that sea-island conjugates or blend spins two types of polymer components that are in separate phases from each other, removes the sea component from the solvent, and makes the remaining island component into nanofiber. For the nanofibers of this system, drawing can be conducted in the same way as typical fiber structures; therefore, the degree of orientation of molecules and degree of crystallization are high, and fibers of relatively high strength are obtained.

However, after spinning or after non-woven fiber manufacture, an abundant amount of the sea component must be removed from the solvent, which has become a cause of a cost increase due to the recovery or waste treatment of the removed sea component being necessary. At the same time, these treatments have not been preferable in terms of the environment either. In addition, the single-fiber fineness of the nanofibers obtained herein is determined by the dispersion state of the island polymer in the sea-island polymer fiber; therefore, concern has remained over the uniformity of the fiber diameter such as variation of the single-fiber fineness of the obtained nanofibers becoming great, if the dispersion is insufficient.

As one other method for production technology of nanofibers, there is the electrospinning method. This method produces fine nanofibers by electrostatic repellent force, by way of applying high voltage between the spray nozzle and the counter electrode upon ejecting a macromolecule solution or the like from a spray nozzle, thereby causing an electric charge to accumulate on a dielectric inside of the spray nozzle. When ejecting nanofibers from the spray nozzle, the polymer is made finer by the electrostatic repellant forces, and thus a nanoscale fine fiber is formed. At this time, the solvent causing the polymer to dissolve is released out of the fiber, and almost no solvent is contained in the deposited nanofiber. Since the nanofiber bundle of an almost dry state is formed immediately after spinning, it is considered a simple production process.

However, the electrospinning method remains with a big problem in the productivity of industrial scale. In other words, since the production volume of nanofibers is proportional to the number of spray nozzles, there is a limit in the technical issue of how much the number of spray nozzles is increased per unit area (or space). In addition, since the polymer ejection volume from each spray nozzle is not fixed, there is a problem in variation in fiber diameter and variation in deposited amount in the non-woven fabric, problem of strength being weak due to drawing not being possible, problem in not being usable by making into short fibers, etc.

In addition, the occurrence of corona discharge can be given as a problematic issue in production derived from using spray nozzles. When a corona discharge occurs, the applying of high voltage to the spray nozzle tip becomes difficult, and the accumulation of sufficient electric charge to the polymer solution inside the spray nozzle is not carried out, and thus it becomes difficult to form nanofibers. Although various methods for suppressing this corona discharge have been considered, the solution has been difficult.

The problem in the productivity from employing such an electrospinning method is derived from using spray nozzles; therefore, considerations of electrospinning methods that do not use spray nozzles are also being carried out. For example, there is a method using a magnetic fluid as an electrode, and performing electrospinning from a macromolecular solution surface, and due to not using spray nozzles, spinning with easy maintenance can be realized, and it has been possible to rapidly improve the spinning rate. However, there remains the problem of the spinning state being very unstable with this method.

As another spinning method that does not use spray nozzles, an electrospinning method using a rotating roll has been proposed. This method is a method of immersing the rotating roll in a bath filled with the polymer solution, thereby attaching the polymer solution onto the roll surface, then applying high voltage to this surface, and performing electrospinning. When compared with a conventional electrospinning method, this has been a ground-breaking method in aspects of the productivity improvement and ease of maintenance. However, there is a limit in the area of the rotating roll portion to be spun, and thus there has been a problem in being necessary to increase the rotating roll diameter or increase the number of rotating rolls in order to further raise productivity, which leads to a size increase in the production facilities.

In addition, a production method of nanofiber masses has been proposed that causes a polymer fiber et to fly from the polymer solution surface and pile up, by incorporating an apparatus to cause air bubbles to form in the bath of polymer solution to which high voltage is applied. However, with this method, upon causing foam to form at the surface of the polymer solution and causing the polymer fiber et to fly from the top of the foam, there is a problem in that the fine spray from the breaking off of the foam will fly and adhere to the nanofiber surface.

With the electrospinning method, further to there being a limit in the productivity and stability of the product, a new large investment is required; therefore, the present inventors have considered there to be a possibility to establish technology that effectively applies a conventional wet-spinning facility to produce continuous nanofibers with little fiber diameter unevenness by way of a direct spinning method, while suppressing new investment expenditures.

As production methods of fibrous bundle (continuous long fiber bundles) consisting of ultrafine fibers by way of a wet-spinning method, various technologies related thereto are disclosed in the publications given next.

Patent Document 1 (Japanese Unexamined Patent Application, Publication No. 2000-328347) describes a spinneret and a production method of acrylic fibers, and describes raising the hole density to 3 to 35 holes/mm$^2$, and being used to wet spin acrylic fibers with a single-fiber fineness of 0.03 to 50 denier.

Patent Document 2 (Japanese Unexamined Patent Application, Publication No. S62-21810) describes a square-shaped nozzle for wet spinning, and describes being able to stably spin 1.5 denier fiber without breaking from a spinning nozzle defining the width, length and block inter-distance of the spinning hole blocks are specific distances, and having a hole density of 16.6 holes/mm$^2$.

Patent Document 3 (Japanese Unexamined Patent Application, Publication No. S51-119826) describes a ultrafine fibrous bundle, production method thereof and a production apparatus thereof, and describes using a spinneret made from a sheet sintered plate made from metallic fiber having a filtration accuracy of at least 15 μm to obtain a ultrafine fibrous bundle having non-uniform fiber cross-section with severe unevenness at 0.01 to 0.5 denier, by way of wet spinning.

The ultrafine fibrous bundle obtained in this way has come to be widely used as life materials including clothing and industrial materials, as already mentioned; however, particularly in recent years, nanofiber non-woven fabric (synthetic paper) made using ultrafine fibers have come to be abundantly used as secondary battery separators equipped to hybrid vehicles and electric cars, filters with improved high functionality, etc. as described and proposed in Patent Document 5 (Japanese Unexamined Patent Application, Publication No. 2012-72519), for example. Conventionally as well, synthetic paper for which synthetic fibers are the raw material have come to be utilized in battery separators, oil filters, electronic wiring substrates, etc. due to having little variation in dimensions from water absorption compared to paper with cellulose as the raw material.

In the past, synthetic paper with synthetic fiber as the raw material came to be utilized in battery separators, oil filters, electronic wiring substrates, etc. due to having little variation in dimensions from water absorption compared to paper with cellulose as the raw material.

On the other hand, as described in Patent Document 4 (Japanese Unexamined Patent Application, Publication No. S58-7760), for example, acrylic fiber paper produced by papermaking the acrylic fibers produced by wet spinning is one of the materials that has come to be widely used in the field of synthetic paper from long ago. Contrary to polyester fibers and polyolefin fibers, since acrylic fibers do not melt fuse even when performing hot calendar processing due to hardly exhibiting thermoplasticity, as well as being hydrophilic and thus excelling in chemical resistance, the acrylic fiber paper has come to be widely used in fields such as the separators of alkali batteries.

The above-mentioned Patent Document 5 describes that, if consisting of an acrylonitrile copolymer obtained by blending at least 93% by mass of acrylonitrile, and the single-fiber fineness is no more than 1.0 dtex, it is preferable because the intertwining of fibers will be moderate upon papermaking, and describes that, if in the range of at least 0.01 dtex to no more than 0.2 dtex, it is more preferable because the uniformity in the papermaking process will be superior, and the industrial productivity can also be ensured.

Patent Document 1: Japanese Unexamined Patent Application, Publication No. 2000-328347

Patent Document 2: Japanese Unexamined Patent Application, Publication No. S62-21810

Patent Document 3: Japanese Unexamined Patent Application, Publication No. S51-119826

Patent Document 4: Japanese Unexamined Patent Application, Publication No. S58-7760

Patent Document 5: Japanese Unexamined Patent Application, Publication No. 2012-72519

DISCLOSURE OF THE INVENTION

Problems to be Solved by the Invention

In order to produce nanofibers without causing the productivity to greatly decline by a conventional wet-spinning method, it is necessary to increase the number of ejection holes per one spinning nozzle by a considerable number. A method of widening the size of the ejection face having the ejection holes has been considered as a method of increasing the hole number of the spinning nozzle; however, if the area of the ejection face of the spinning nozzle is slightly increased, it becomes difficult to replace the coagulation liquid having raised concentration with coagulation liquid of a specified concentration in the vicinity of the election holes arranged at the central part of the spinning nozzle, and thus defects arise in fiber formation from the ejection holes arranged at the central part. In addition, a problem arises in that the ejection face deforms (swells) due to the ejection pressure of the spinning dope. Furthermore, it is not possible to store in an already established coagulation tank, and thus the cost of newly building a coagulation tank and the installation space of a coagulation tank also newly become required. In order to suppress the facility investment expenditures from such a situation, arranging the holes in high density is a better plan than increasing the size of the spinning nozzle ejection face.

It is necessary to narrow the pitch P1 between holes in order to arrange the ejection holes of the spinning nozzle in high density; however, if the pitch P1 between holes is made too narrow, it will be difficult to replace the coagulation liquid of raised concentration with coagulation liquid of specified concentration in the vicinity of the ejection holes arranged at the central part of the ejection face of the spinning nozzle, and thus defects in the fiber formation from the ejection holes arranged at the central part, i.e. fibers in which several tens to several hundreds are adhered, may also arise.

With the above-mentioned technology described in Patent Document 1, an example is given in which the hole density of the porous nozzle for wet spinning is 35 holes/mm$^2$, and the hole density in the Examples thereof is 11 holes/mm$^2$, and according to the above-mentioned Patent Document 2, an example is given in which the hole density of the porous nozzle is 16.6 holes/mm$^2$ in the Examples thereof; however, although a spinning nozzle having the hole density of these Examples can sufficiently handle production on an industrialized basis so long as being a fiber on the order of 0.4 to 1.0 dtex like the microfibers of recent prevalence, if producing fibers of nanofiber level, the productivity remarkably dropping due to the total number of fibers being small and an increase in cost are unavoidable. In addition, since the nozzle will become larger when trying to increase to total number of fibers, the equipment will increase in size, and dope ejection irregularity can happen.

In addition, even if the hole density is raised, it is considered that the adhesion between fibers will frequently occur.

According to the above-mentioned Patent Document 3, upon wet spinning using a sheet sintered plate made from metallic fibers having a filtration accuracy of at least 15 μm diameter, it is proposed to block the ejection face side of the sheet sintered plate with resin or the like so that the coagulation liquid uniformly penetrates to produce fibers of 0.01 to 0.5 denier; however, the target is not nanofibers, and as mentioned previously, the fineness thereof is 10 to 50 times as thick, and the fiber cross-section formed is irregular and non-uniform in both the cross-sectional shape and fiber diameter, and thus is not appropriate as the raw material of high precision filters, etc.

Based on this, in order to produce uniform, continuous nanofibers at high efficiency with a wet direct-spinning method, it is necessary to meticulously arrange the holes of the spinning nozzle at unprecedented high density. However, with the punch machining methods for conventional spinning nozzles, when calculating based on the machining cost per hole, although enormous investment expenditures become necessary for ultrahigh-density porous nozzle manufacture, in addition to the cost problems thereof, the hole density has had a limit upon manufacture of 35 holes/mm$^2$ with the conventional punch machining technology. In addition, in order to meticulously punch the ejection holes of a spinning nozzle in high density, the plate thickness of the nozzle must be made considerably thinner, and thus a problem in that the spinning nozzle face not only swells but also ruptures due to the ejection pressure of the spinning dope has been of concern.

The present invention has been made by taking account of the above-mentioned situation, and establishes the problem of providing a super-porous spinning nozzle that can produce bundles of uniform, continuous nanofibers at high efficiency using a method that directly spins stably with a wet spinning system, and technology for producing nanofibers using this spinning nozzle.

In addition, although only paper with a paper density (weight per area) of 10 g/m$^2$ or higher can be manufactured in the case of using fibers of 0.1 denier, for the paper produced with nanofibers, it is possible to manufacture 3 to 5 g/m$^2$ paper, and thus it is possible to manufacture paper that is thin and has high strength.

Means for Solving the Problems

A spinning nozzle of the present invention is a spinning nozzle including a perforated part having a number of ejection holes per square mm of at least 600 holes/mm$^2$ to no more than 1,200 holes/mm$^2$.

The spinning nozzle of the present invention preferably has an opening area of one of the ejection holes of at least 100 μm$^2$ to no more than 350 μm$^2$.

The spinning nozzle of the present invention preferably has a total number of the ejection holes of at least $8\times10^5$ to no more than $25\times10^5$ holes.

The spinning nozzle of the present invention preferably has an inter-outer edge distance between one election hole and an ejection hole closest to said ejection hole of at least 10 μm to no more than 20 μm.

In the spinning nozzle of the present invention preferably, it is preferable for all of the ejection holes to have a course for which a distance from an outer edge of said ejection hole to a perforated part outer peripheral line of a perforated part in which the ejection hole arranged is no more than 2 mm.

A process for producing a fibrous bundle of the present invention is a process that includes: ejecting a spinning dope from the ejection holes of any of the aforementioned spinning nozzles; and obtaining a fibrous bundle having a single-fiber fineness of at least 0.005 dtex to no more than 0.01 dtex, and a total fineness of at least 4×10 dtex to no more than $8\times10^5$ dtex.

In the process for producing a fibrous bundle of the present invention, it is preferable for a viscosity at 50° C. of the spinning dope to be ejected from the ejection holes to be at least 30 poise to no more than 200 poise.

In the process for producing a fibrous bundle of the present invention, it is preferable for a specific viscosity of a polymer dissolved in the spinning dope to be at least 0.18 to no more than 0.27.

In the process for producing a fibrous bundle of the present invention, constituent fibers of the fibrous bundle are preferably acrylic fibers.

The process for producing a fibrous bundle of the present invention preferably includes providing an oil solution treatment liquid having a concentration of oil solution of 3 to 10% to a fiber produced by electing the spinning dope from the ejection nozzle of the spinning nozzle, and drying the fiber while the oil solution treatment liquid adheres thereto.

A fibrous bundle of the present invention is a fibrous bundle having a single-fiber fineness of at least 0.005 dtex to no more than 0.01 dtex, and a total fineness of at least $4\times10^3$ dtex to no more than $8\times10^5$.

It is preferable for the constituent fibers of the fibrous bundle of the present invention to be acrylic fibers, and the length of the fibrous bundle to be at least 1 mm to no more than 200 mm.

The fibrous bundle of the present invention preferably has a unit-fineness converted strength of at least 3.0 cN/dtex to no more than 7.0 cN/dtex.

Paper of the present invention contains at least 80% by mass to no more than 85% by mass of a fiber, the fiber having a single-fiber fineness of at least 0.005 dtex to no more than 0.01 dtex, in which paper density is at least 3 g/m$^2$ to no more than 30 g/m$^2$.

The paper of the present invention preferably has a length of a fibrous bundle of at least 1 mm to no more than 10 mm.

The paper of the present invention preferably has a tensile strength in a length direction having a paper width of 15 mm of at least 3.0 N/mm$^2$ to no more than 13.5 N/mm$^2$, and an air permeance of at least 0.1 seconds to no more than 1.0 second.

Effects of the Invention

According to the present invention, in a method using a super-porous spinning nozzle to directly spin with a wet spinning system, stable spinning is possible, and a fibrous bundle of uniform, continuous nanofibers can be produced at high efficiency, whereby ultrafine fibers having very little adhesion between single-fibers are provided.

In addition, when employing the fibers of the present invention, it is possible to provide paper excelling in strength despite having low paper density (weight per area).

PREFERRED MODE FOR CARRYING OUT THE INVENTION

<Spinning Nozzle>

Figure 1:
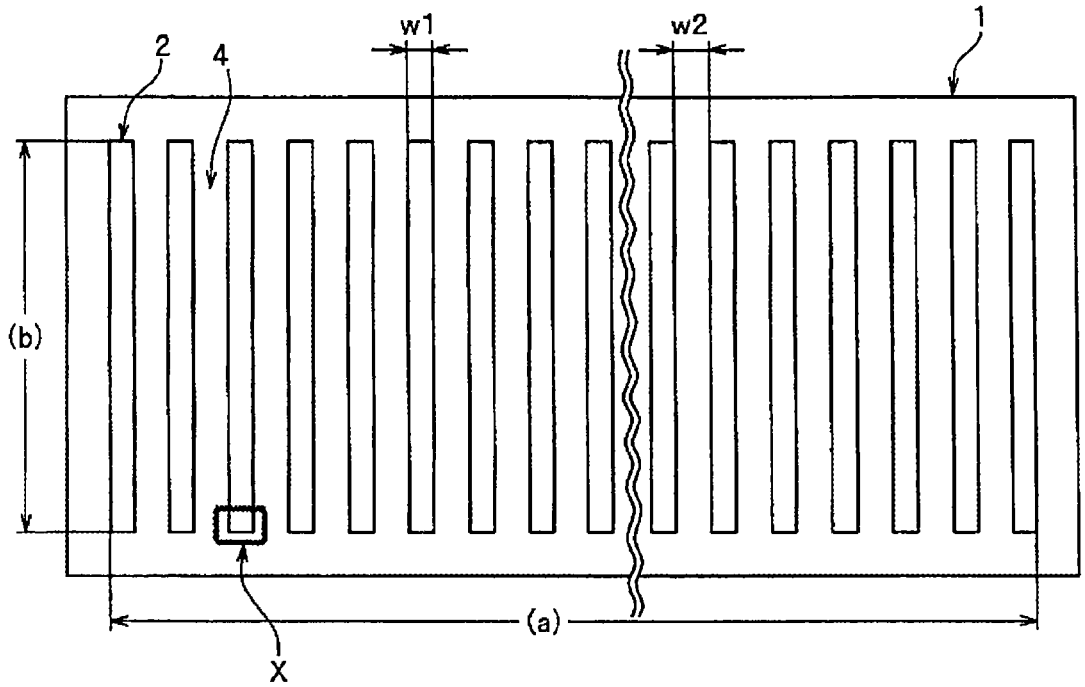
FIG. 1 is a schematic drawing showing an example of the arrangement of ejections holes of a nozzle overall.

A spinning nozzle 1 of the present invention is a spinning nozzle in which the number of ejection holes per 1 square mm is at least 600 holes/mm$^2$ to no more than 1,200 holes/mm$^2$.

If the number of ejection holes per 1 square mm is at least 600 holes/mm$^2$, it will be possible to efficiently produce ultrafine fibers without the spinning nozzle 1 becoming larger. In addition, if the number of ejection holes per 1 square mm is no more than 1,200 holes/mm$^2$, the adhesion between single-fibers tends to be reduced.

The lower limit value for the number of ejection holes per 1 square mm is preferably at least 700 holes/mm$^2$, and more preferably at least 800 holes/mm$^2$, from this viewpoint. The upper limit value for the number of ejection holes per 1 square mm is preferably no more than 1,100 holes/mm$^2$, and more preferably no more than 1,000 holes/mm$^2$, from this viewpoint.

Figure 2:
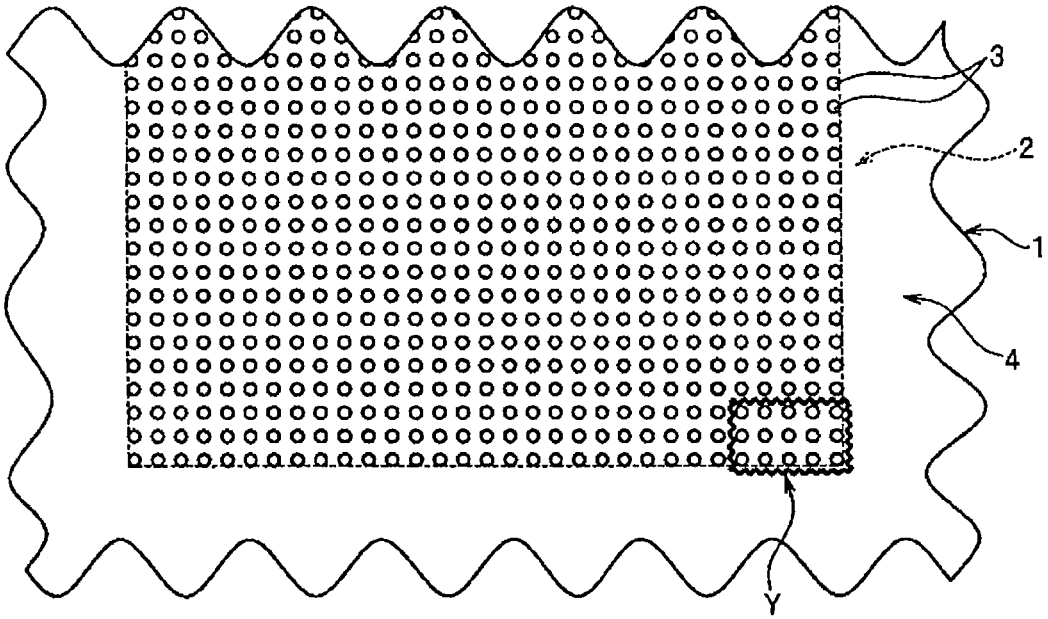
FIG. 2 is a schematic drawing showing an arrangement example of ejection holes, enlarging the part X of a perforated part shown in FIG. 1.
Figure 3:
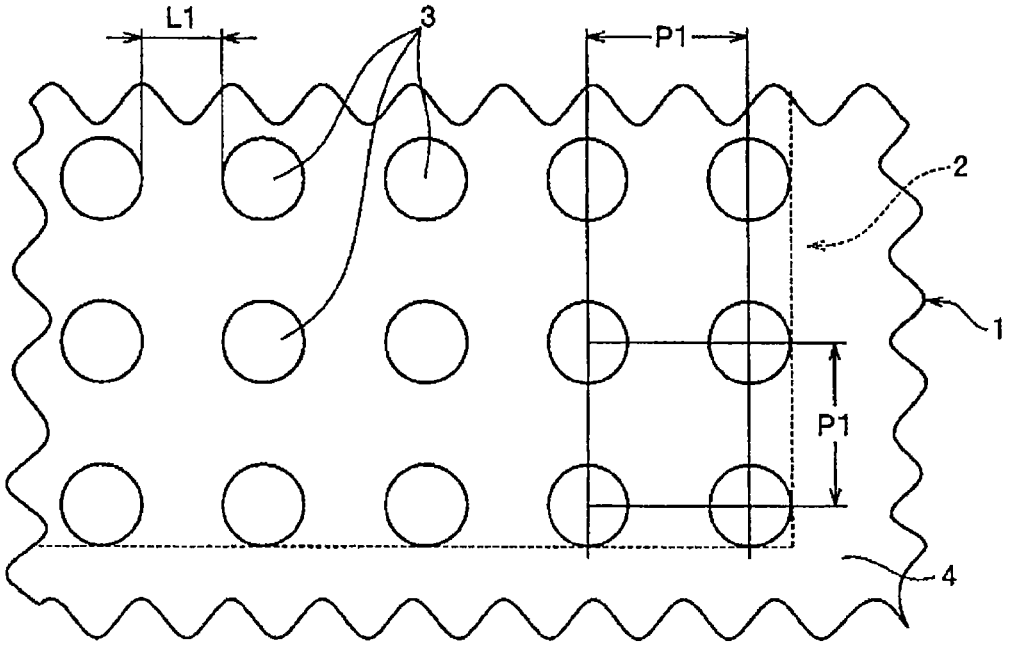
FIG. 3 is a schematic drawing showing an arrangement example of ejection holes further enlarging a part Y of a perforated part shown in FIG. 2.
Figure 4A:
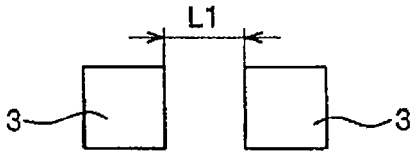
FIG. 4 (4A to 4D) provides exemplary drawings showing the distance between outer edges of a plurality of ejection holes.
Figure 4B:
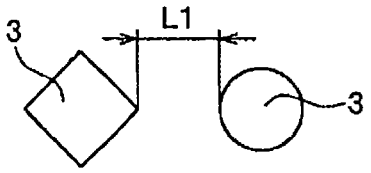
Figure 4C:
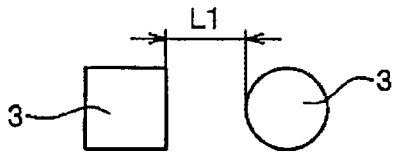
Figure 4D:
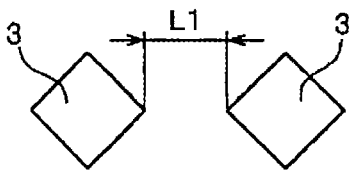
Figure 5:
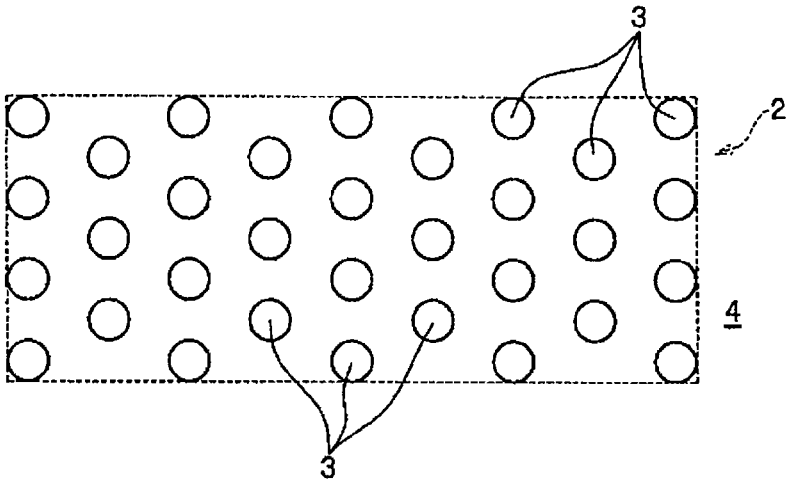
FIG. 5 is a drawing showing an example of an external tangential line of a perforated part.
Figure 6:
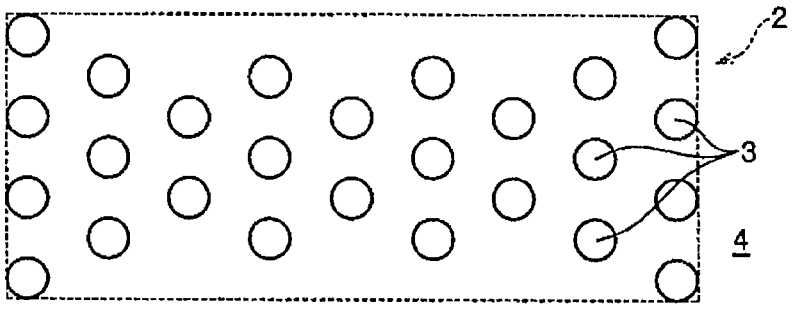
FIG. 6 is a drawing showing another example of an external tangential line of a perforated part.

As shown in FIGS. 2 and 3, a portion in which a plurality of ejection holes 3 are gathered and the number of ejection holes per 1 square mm is at least 600 holes/mm$^2$ to no more than 1,200 holes/n is defined as a perforated part 2, and by drawing a line contacting the edge of the ejection holes 3 placed at the outer periphery of the perforated part 2, this line is defined as a perforated part peripheral line, and the area surrounded by the perforated part peripheral line is defined as a perforated part area.

A non-perforated part refers to as a portion that is not a perforated part.

The spinning nozzle 1 of the present invention obtains the ejection holes 3 of the spinning nozzle 1 by mold manufacture of ejection holes by a photoresist method, and precipitating metal on the mold by way of an electroforming method, and subsequently removing the mold of the ejection holes.

The spinning nozzle of the present invention can created by Semtech Engineering Co., Ltd.

The spinning nozzle 1 of the present invention preferably consists of the perforated part 2 made by at least two ejection holes 3 being arranged to gather, and a non-perforated part 4 without the ejection holes 3.

By having the non-perforated part 4, the coagulation liquid of a specified concentration tends to enter the dope ejected from the central part of the perforated part 2.

The spinning nozzle 1 of the present invention preferably has an area of one ejection hole 3 of at least 100 μm$^2$ to no more than 350 μm$^2$. If the area of one ejection hole 3 is at least 100 m$^2$, it is preferable since foreign contamination will not easily clog, and the filtration load tends to be reduced.

In addition, if the area of one ejection hole 3 is no more than 350 μm$^2$, a single fiber of nano-order size will tend to be obtained.

The lower limit value for the area of one ejection hole 3 is more preferably at least 150 μm$^2$, and even more preferably at least 200 μm$^2$, from this viewpoint. In addition, the upper limit value for the area is more preferably no more than 300 μm$^2$, and even more preferably no more than 250 μm$^2$, from this viewpoint.

The spinning nozzle 1 of the present invention preferably has a number of ejection holes 3 of at least $8\times10^5$ to no more than $25\times10^5$. If the number of ejection holes 3 is at least $8\times10^5$, the productivity rises, and the cost tends to be reduced. In addition, if the number of ejection holes 3 is no more than $25\times10^5$, adhesion tends to be reduced.

The lower limit value for the number of the ejections holes 3 is more preferably at least $9\times10^5$, and even more preferably at least $10\times10^5$. The upper limit value for the number of the ejection holes 3 is more preferably no more than $23\times10^5$, and even more preferably no more than $20\times10^5$.

As shown in FIGS. 3 and 4, for the ejection hole 3 and a closest ejection hole 3 to this ejection hole 3, the spinning nozzle 1 of the present invention preferably has an inter-outer edge distance L1 between both ejection holes 3,3 of at least 10 μm to no more than 20 μm. The shapes of the ejection hole 3 are independently a square or circle, and are combinations of these, as shown in FIG. 4, for example. However, it is not limited to the shapes and combinations shown in FIG. 4

If the inter-outer edge distance L1 between the ejection holes 3,3 is at least 10 μm, the coagulation liquid will tend to infiltrate between fibers ejected from the ejection holes 3,3. In addition, if no more than 20 μm, the hole density can easily be increased, and thus nanofibers can be efficiently produced without the nozzle becoming larger.

From this viewpoint, the lower limit value for the inter-outer edge distance between both ejection holes 3,3 is more preferably at least 12 μm, and the upper limit value is more preferably no more than 17 μm.

Since the spinning nozzle 1 of the present invention has the ejection holes 3 arranged in very high density, the coagulation liquid at the periphery of the fibers ejected from the ejection holes 3 near the center of the gathering part of the ejection holes 3 is easily replaced, thereby making fiber formation uniform to prevent fineness irregularity and adhesion; therefore, it is preferable to divide the gathering parts of the ejection holes into several perforated parts to facilitate the coagulation liquid of specified concentration entering to the center of the gathering part of the ejection holes 3.

An example thereof is shown in FIG. 1.

As shown in the same figure, it is necessary to try to adjust the width of a short side of the perforated part 2 at which the ejection holes 3 of a dope ejection portion of the spinning nozzle 1 gather (hereinafter referred to as perforated part width w1), the interval between the perforated part 2 and an adjoining perforated part 2 (hereinafter referred to as lane width w2), and the length of the long side of a perforated part group, to make so that the coagulation liquid sufficiently infiltrates until the central part of the perforated part 2 of the spinning nozzle 1.

Despite being the appropriate size for this perforated part 2, it is also related to the hole density and dope (viscosity), and wet coagulation conditions (coagulation concentration and temperature); however, it is preferable to make so that the perforated part width w1 does not exceed 4 mm. In addition, the lane width w2 is preferably set to at least 1.5 mm. In addition, in the case of the perforated part width w1 and the lane width w2, the length (b) of the short side of the perforated part group is preferably set to no more than 50 mm.

For this reason, in the spinning nozzle 1 of the present invention, all of the ejection holes 3 have a course for which the distance from the outer edge of this ejection hole 3 until the perforated part outer peripheral line of the perforated part 2 in which the ejection holes 3 are arranged that is preferably no more than 2 mm, is more preferably no more than 1.5 mm, and even more preferably no more than 1 mm.

If having a course for which the distance until the perforated part outer peripheral line is no more than 2 mm, since the coagulation liquid will tend to enter to the inner side of the perforated part 2, the dope ejected from the inside part of the perforated part will also tend to congeal, whereby adhesion between fibers can be reduced, and the quality will tend to be made uniform.

In the spinning nozzle 1 of the present invention, a plurality of the perforated parts 2 are arranged, and the shortest distance between one perforated part 2 and an adjoining perforated part 2 is preferably at least 1.0 mm.

If the shortest distance is at least 1.0 mm, the coagulation liquid will tend to flow between the perforated parts, and the coagulation liquid will tend to further flow to the center of the perforated part.

From this viewpoint, the shortest distance is more preferably at least 2.0 mm, and even more preferably at least 3.0 mm. The upper limit value for the shortest distance is preferably no more than 10 mm, more preferably no more than 7 mm, and even more preferably no more than 5 mm, from the point of making so that the nozzle does not become too large.

With the spinning nozzle 1 of the present invention, the perforated part 2 is not particularly limited so long as the perforated part 2 can be efficiently arranged so that the flow of coagulation liquid is favorable; however, for the aforementioned perforated part 2, it is preferable for the shape thereof to be rectangular, and in this case, the long sides of the rectangle to be arranged in parallel.

FIG. 1 is a plan view looking at the main body of the super-porous spinning nozzle 1 of the present invention from the nozzle face. In the same figure, a case of dividing the perforated part 2 of the spinning nozzle face into sixteen blocks is shown; however, it is not to be limited to sixteen blocks.

Although the spinning nozzle 1 is a design housed in a square pack, even if a circular nozzle, the objects of the present invention can be sufficiently achieved so long as appropriately designing the divisions of the perforated parts 2. However, if the space of the coagulation tank is the same, a square nozzle pack is advantageous due to the total number of holes being increased over a circular nozzle pack system.

As the technique for obtaining the ejection holes 3 in the spinning nozzle 1 of the present invention, an electroforming method is preferable. If employing an electroforming method, the hole diameter can be reduced down to the order of several μm diameter, and the inter-outer edge distance of adjacent ejection holes 3 can be narrowed to close to 10 μm.

In addition, since it is possible to manufacture the perforated part 2 of the nozzle holes 3 and the non-perforated part 4 of the spinning nozzle 1 with a design as designated, it is also possible to adjust the infiltration path (non-perforated part 4) of the coagulation liquid. In addition, there is a merit in that cost reduction is possible compared to the conventional processing technology of ejection holes.

The spinning nozzle 1 of the present invention preferably has a reinforcing frame at the face at which the spinning dope is introduced (infiltration path face) to the ejection hole 3. By having a reinforcing frame, deformation of the spinning nozzle due to the ejection pressure tends to be prevented.

<Process for Producing Fibrous Bundle>

The process for producing a fibrous bundle of the present invention is a production method of fibrous matter that uses the aforementioned spinning nozzle 1, and ejects spinning dope from the ejection holes 3 thereof to obtain the fibrous matter.

As the spinning dope, so long as being ejectable from the fine holes of the present invention, it is not particularly limited; however, a dope for which the viscosity can be lowered is preferable. From the point of being possible to lower the viscosity, it is more preferable to adjust the viscosity when using a dope made by polymer dissolving in solvent.

From this viewpoint, using a dope made by dissolving a polyacrylonitrile-based polymer in solvent is more preferable.

In the production process of fibrous material of the present invention, the viscosity of the spinning dope ejecting from the ejection holes 3 is preferably at least 30 poise to no more than 200 poise.

If the viscosity is at least 30 poise, the fibers making a porous structure will tend to be reduced, whereby a decline in strength tends to be suppressed. If the viscosity is no more than 200 poise, the spinning dope will easily be ejected from the ultrafine ejection holes 3 of the present invention, whereby deformation of the nozzle due to pressure tends to be prevented.

From this viewpoint, the lower limit value for the viscosity is more preferably at least 50 poise, and even more preferably at least 100 poise. The upper limit value for the viscosity is more preferably no more than 180 poise, and even more preferably no more than 150 poise.

In the production process of fibrous material of the present invention, the specific viscosity of the polymer dissolving in the spinning dope is preferably at least 0.18 to no more than 0.27.

If the lower limit value for the specific viscosity is at least 0.18, it is preferable since the formation of fibers is facilitated, and is more preferably at least 0.02, and even more preferably at least 0.22. In addition, if the upper limit value for the specific viscosity is no more than 0.27, it is preferable since the viscosity of the dope will not become too high and thus will easily eject from the holes, and is more preferably no more than 0.25, and even more preferably no more than 0.23.

The production process of the fibrous material of the present invention preferably is a wet spinning method that performs election of the spinning dope into a coagulation liquid.

The production process of fibrous bundle of the present invention preferably has an drawing process after ejecting the spinning dope into the coagulation liquid, of elongating the fibrous bundle in hot water of at least 98° C., in which the drawing rate is at least 2.5 times to no more than 6 times.

If the temperature of the hot water in the drawing process is at least 98° C., fibers will easily be elongated, whereby the fibers that break tend to be reduced.

If the lower limit value for the drawing rate is at least 2.5 times, it will excel in spinning passability, and the strength required during treating of fibers will tend to be obtained. The lower limit value for the drawing rate is more preferably at least 3.0 times, and even more preferably at least 3.5 times, from this viewpoint. In addition, if the upper limit value for the drawing rate is no more than 6.0 times, the threads that break tend to be reduced, and thus the stability in the spinning process tends to rise. The upper limit value for the drawing rate is more preferably no more than 5.5 times, and even more preferably no more than 5.0 times from this viewpoint.

The production process of a fibrous bundle of the present invention preferably has a dry-heat drawing process that performs drawing to at least 1.3 times and no more than 3 times by further heating the fibrous bundle with dry heat to at least 175° C. and no higher than 200° C.

If the dry-heat temperature is at least 175° C., it will be easily elongated to the desired drawing rate, and if no higher than 200° C., deterioration due to heating of the fibers will tend to be reduced.

The lower limit value for the dry-heat temperature is more preferably at least 180° C. from this viewpoint. The upper limit value for the dry-heat temperature is more preferably no higher than 195° C., and even more preferably no higher than 190° C., from this viewpoint.

Hereinafter, the method of wet spinning nanofibers using the spinning nozzle 1 of the present invention will be explained in detail.

Upon the production of nanofibers of the present invention, the hole diameter of the ejection holes 3 of the spinning nozzle 1 are preferably at least 10 μm diameter, and more preferably at least 15 μm diameter, from the viewpoint of preventing clogging. From the viewpoint of filtration resistance of the spinning dope in the present invention, the viscosity of the spinning dope is preferably 30 to 200 poise.

As a method of controlling the viscosity of the spinning dope to the range of 30 to 200 poise, there is the method of lowering the degree of polymerization of the polymer itself and the method of lowering the polymer concentration of the spinning dope; however, the method of lowering the polymer concentration of the spinning dope is preferred from the viewpoint of the properties of the fiber.

For the case of the method of lowering the polymer concentration, due to being able to maintain the properties of the fiber, as well as the spinning stability improving as the draft ratio at the ejection face of the spinning nozzle becomes smaller, it is a method suited to the production of nanofibers.

For the polymers that can be used in the spinning dope of the present invention, any can be used so long as wet spinning is easily carried out therewith, and for example, cellulose, cellulose acetate, other cellulose derivatives, polyacrylonitrile-based polymers, polyvinylalcohol-based polymers, polyvinylchloride-based polymers, polyvinylidine chloride-based polymers, polyamide-based polymers, polyimide-based polymers, etc. can be exemplified.

In addition, since the hole diameter of the ejection holes of the spinning nozzle is small, it is preferable to enhance the filtration of the spinning dope. Generally, the occurrence of ejection hole plugging of the spinning nozzle and the difficulty in washing the ejection holes suddenly rises when the hole diameter becomes 45 μm or less, and tends to be the cause of spinning trouble.

Therefore, in the present invention, it is preferable to perform filtration using a filter media having filtration accuracy that is smaller than the hole diameter of the ejection holes of the spinning nozzle, and thus a sintered metal non-woven sheet, sintered metal woven sheet, sintered compact of metal powder, etc. are preferable as the filter media, and it is further desirable for the filtration accuracy to be no more than 5 μm. In this case, the matter of the spinning dope viscosity being low acts very advantageously. In other words, since filtration is only performed using filter media of high filtration accuracy, if the viscosity if high, it will lead to a situation where the filtration pressure becomes too high and spinning is not possible. In addition, if the polymer concentration is lowered with the object of lowering the dope viscosity, the filtration efficiency will further improve and the rise in the filtration pressure will become small; therefore, it is a very advantageous condition connected to the aforementioned spinning stability improvement.

When wet spinning using a spinning nozzle of small hole diameter and a low-viscosity spinning dope in this way, coagulation will become relatively fast, and even if the ejection hole density is made remarkably large, there will be an advantage in adhesion prevention between fibers.

The coagulated fibers spun in the above way are successively washed, elongated and supplied an oil solution. For the drawing, a known drawing method such as air drawing, hot-water drawing, steam drawing and combinations thereof are employed as is.

Next, the drying and drawing of undried wet fibers may be performed by known methods. For example, after firing and crushing the voids by a calendar roll drying method or hot-air drying method, it may be used as is. Alternatively, after firing and crushing the voids, upon successively raising the temperature of the fiber bundle to 175 to 185° C. under dry heat, and it may be elongated in air. In addition, as another drawing means, it may be elongated in saturated steam at 1.5 to 3.5 $kg/cm^2G$. Generally, since the drawing rate is more efficiently raised by steam drawing, while maintaining spinning stability, it is an advantageous means in order to make the fibers finer.

The fibrous bundle ejected from one nozzle has a small total fineness, and thus the spinning property and handling of the fiber bundle improve; therefore, by combining fiber bundles ejected from a plurality of nozzles, it is possible to make one fibrous bundle.

As a method of combining a fibrous bundle ejected from one nozzle, a method of arranging a plurality of nozzles in one nozzle pack and collecting in a coagulation tank simultaneously, a method of combining in a spinning process in which the fibrous bundle ejected from one nozzle is in a wet state, a method of combining dried fibrous bundles in the spinning process or after the spinning process, etc. are possible.

Which method is adopted may be decided in accordance with the processability of the spinning process, productivity, quality, handling property, intended use, etc.

<Fibrous Bundle>

The fibrous bundle of the present invention has a single-fiber fineness of at least 0.001 dtex to no more than 0.01 dtex.

If the single-fiber fineness is at least 0.001 dtex, it is preferable since a decline in the strength of the fiber tends to be suppressed, and it is more preferably at least 0.003 dtex, and even more preferably at least 0.005 dtex. It should be noted that if the single-fiber fineness is no more than 0.01 dtex, it is possible to provide an ultrafine fiber, which is demanded in material uses.

The fibrous bundle of the present invention preferably has a total fineness of at least $4\times10^3$ dtex to no more than $8\times10^5$ dtex. If the total fineness is in the above-mentioned range, handling will be easy.

The fibrous bundle of the present invention preferably is acrylic fiber.

The fibrous bundle of the present invention includes short fibrous bundles in addition to long fibrous bundles.

The short fibrous bundle of the present invention is a fibrous bundle made by cutting a long fibrous bundle to a length of at least 1 mm to no more than 200 mm. If the length of the short fibrous bundle is this range, the handling will be easy.

The length of the short fibrous bundle is more preferably no more than 100 mm, and even more preferably no more than 50 mm, from the point of dispersibility in water upon papermaking.

The short fibrous bundle of the present invention preferably has a unit-fineness converted strength of at least 3.0 cN/dtex to no more than 7.0 cN/dtex.

If the strength is at least 3.0 cN/dtex, handling of the fiber bundles can be done easily, and when made into paper, it becomes possible to easily raise the strength of the paper, even when lowering the paper density (weight per area) of the paper. In addition, if no more than 7.0 cN/dtex, the handling property will be favorable.

From this viewpoint, the strength is more preferably at least 4.0 cN/dtex, and even more preferably at least 5.0 cN/dtex.

Furthermore, undried wet fibers that are in the middle of the spinning process can also be used as is. Since the number of fibers increases when the fiber diameter is very small, the interlacing property is very high and can be made into paper as is, and thus by cutting to shorten to the appropriate length, dispersing into water, and then papermaking, it is possible to make into paper. For the paper that can be made, a paper excelling in adsorption property is obtained due to the porous structure thereof and the single-fiber diameter being very small. In the present invention, "paper" refers to paper and non-woven fabric.

The paper of the present invention is paper containing fibers produced by the present fibrous bundle dispersing.

In addition, the paper of the present invention preferably has a length of fibers obtained from the above-mentioned fibrous bundle of at least 1 mm to no more than 10 mm.

If the length of fibers is at least 1 mm, a strength enduring use when made into paper tends to be maintained, and if no more than 10 mm, the entanglement of single fibers will be few.

From this viewpoint, the length of the present fibers is preferably at least 3 mm to no more than 7 mm.

The paper of the present invention preferably contains 70 to 95% by mass of the above-mentioned fibrous bundle of the present invention.

If the content of the fibrous bundle of the present invention is at least 70% by mass, paper of light paper density (weight per area) will tend to be obtained. If the content of fibrous bundle is no more than 95% mass, it will be possible to have the required amount of binder contained.

In the point of lightening the paper density (weight per area) of the paper, the content of the fibrous bundle of the present invention is preferably at least 80% by mass, and more preferably at least 85% by mass.

The paper of the present invention preferably contains at least 5 to 20% by mass of binder.

For the paper of the present invention, the paper density (weight per area) of this paper is preferably 3 to 30 g/m$^2$.

If the paper density (weight per area) is at least 3 g/m$^2$, the strength for use as paper tends to be maintained. There is no particular upper limit; however, to obtain paper with a light paper density (weight per area) using the fibrous bundle of the present invention, it is preferably no more than 30 g/m$^2$.

In order to establish lighter paper, the paper density (weight per area) of the paper is more preferably no more than 15 g/m$^2$, and even more preferably no more than 8 g/m$^2$.

The paper of the present invention preferably has a tensile strength in the length direction with a paper width of 15 mm of at least 3.0 N/mm to no more than 13.5 N/mm.

If the tensile strength is at least 3.0 N/mm, it will excel in handling property, and thus be usable in filters, etc. From this viewpoint, the tensile strength is more preferably at least 6.5 N/mm, and even more preferably 8.5 N/mm.

The paper of the present invention preferably has an air permeance of at least 0.1 seconds to no more than 1.0 seconds. If at least 0.1 seconds, it will tend to collect foreign contamination s as a filter function, and if no more than 1.0 seconds, the filter will not easily clog. From this viewpoint, the air permeance is more preferably at least 0.2 seconds, and more preferably no more than 0.7 seconds.

In industrial material uses, after shortening by cutting the obtained continuous fibrous bundle to an arbitrary length and wet papermaking, it is possible to use as paper, and as a high-performance filter and high-performance adsorbent. Furthermore, depending on the raw material polymer, it has been considered to calcine the obtained paper and use in the battery separator of a lithium-ion battery.

In the case of using in a clothing application, it is possible to perform thermal relaxation treatment by a known method to obtain fibers with improved stainability and achieving a balance of strength and elasticity. The continuous fibrous bundle obtained in this way is shortened by cutting, subjected to wet papermaking and bound into textile-based cloth by a water-jet method, and napping processed after drying, a very soft and visually beautiful suede prepared article is obtained.

In addition, from a knitted fabric manufactured from spun yarn obtained from a known wool carding method after manufacturing slivers by stretching and cutting the continuous fibrous bundle with a known fascicle (tow converter), a peach skin-type product with a superior soft feeling and glossy feeling is obtained.

The continuous fibrous bundle of nanofibers obtained by the present invention may be used in new textured materials as filaments of nanofiber or staples by stretching and cutting as mentioned previously, and may be used as one component of sheet raw materials by cutting and beating this continuous fibrous bundle. Additionally, the fact that the fiber surface area is large can be employed to apply as various adsorbents. In this way, the continuous fibrous bundle of nanofibers obtained by the present invention can be expected to have wide-ranging practical uses. Particularly in the case of using as an adsorbent, it is preferable to employ an undried porous structure.

Hereinafter, the present invention will be explained specifically by providing Examples. However, the present invention is not to be limited to these.

EXAMPLES

<Spinning Property Evaluation>

The spinning property was evaluated in the following way.

○: spinnable without thread breakage or entwining Adhered fibers slightly present Δ: spinnable without thread breakage or entwining Few Adhered Fibers Present ▲: thread breakage occurred <Single-fiber Fineness>

The measurement method of the single-fiber fineness cuts a fibrous bundle that had been dried for 20 minutes at 100° C. into lengths of 1 m, and measures the mass thereof.

From this result, the total fineness of the fibrous bundle is calculated, and the value from dividing the total fineness by the number of ejection holes of the spinning nozzle is defined as the single-fiber fineness.

<Unit-Fineness Converted Strength>

For the case of a fiber bundle having a total fineness less than 2,000 dtex, twisting was done 35 times/m; for the case of the total fineness being at least 2,000 dtex to less than 3,000 dtex, twisting was done 20 times/m, for the case of at least 3,000 dtex to less than 6,000 dtex, twisting was done 15 times/m, and for the case of at least 6,000 dtex, twisting was done 10 times/m, then elongated to a measurement length of 250 mm at a stretching rate of 50 mm/min with a TENSILON (RTC-1325A manufactured by ORIENTEC), and the strength at the time of breaking was measured. Subsequently, the strength at the breaking time was divided by the total fineness of the fiber bundle to calculate the unit-fineness converted strength.

<Measurement Method of Paper Strength>

For the tensile strength of paper, measurement was conducted using a tensile tester AG-IS manufactured by Shimadzu Corp. with a load cell of 1 kN according to a method based on JIS P8113. A 15×100 mm sample was elongated at a tension rate of 10 mm/min, and the strength at the breaking time was measured.

<Measurement Method of Air Permeance>

Evaluation was conducted for air permeance according to the Gurley test equipment method based on JIS P8117.

Example 1

<Spinning Nozzle>

A spinning nozzle with a hole density of 1,111 holes/mm$^2$, ejection hole area of 176.6 μm$^2$, ejection hole inter-outer edge distance of 0.015 mm, perforated part width of 1 mm, inter-perforated part distance of 2 mm, number of perforated parts of 30, and total number of holes of $1.17\times10^6$ holes was created using nickel as the material by Semtech Engineering Co., Ltd. by the electroforming method. The ejection hole arrangements are as shown in FIGS. 1 to 3

<Manufacture of Nanofibers by Wet Spinning>

A spinning dope was prepared with 16% by mass polymer concentration by dissolving a polymer of 0.200 specific viscosity consisting of 91% by mass of acrylonitrile units and 9% by mass of vinyl acetate units (dissolving 0.5 g of polymer is 100 ml of dimethylformamide, measured at 30° C.; similarly in the following) in dimethylformamide (hereinafter abbreviated as DMAc), and then filtering with a sintered metal filter of 5 μm filtration accuracy. The viscosity thereof was 70 poise at 50° C.

Next, the spinning dope was elected through the above-mentioned nozzle into a coagulation liquid of 30% by mass of DMAc at 50° C., from the ejection holes of the spinning nozzle created as previously described.

The dope ejection rate was $6.5\times10^{-5}$ cc/min per one ejection hole of the spinning nozzle. The coagulated fiber produced by the spinning dope coagulating the coagulation liquid, the take-up speed of the coagulated fiber leaving from the coagulation liquid to the first roller was 2.1 m/min. Next, the coagulated fiber was introduced into hot water at 98° C. to wash and remove DMAc, while conducting drawing at 4.4 times, an oil solution was provided to the coagulated fiber, and then dried by a dry roll method. Next, a fibrous bundle was obtained by heating to 170° C. with dry heat, and conducting drawing at 2.2 times.

The obtained fibrous bundle had a total fineness of 5,850 dtex and single-fiber fineness of 0.005 dtex, without problems such as thread breakage and entwining in the spinning process.

The results thereof are shown in Table 1.

Upon observing the obtained fiber bundle with a scanning electron microscope, fibers of nano-order level at 800 to 1,200 nm were observed. In addition, adhered fibers attributable to the spinning nozzle were not recognized.

Examples 2 to 7

Fibrous bundles were obtained by performing spinning in the same way as Example 1, except for using the nozzles described in Table 1.

The spinning results thereof are shown in Table 1.

Examples 2 to 5 and 7 were able to be spun without thread breakage or entwining. Although a slight amount of adhered fibers formed, it was not to an extent that would become a problem.

In Example 6, the amount of adhered fibers became great compared to Example 1; however, it was in a range still usable in terms of quality. As the cause for the adhesion increasing, it is considered that the perforated part width became larger at 3 mm, and thus the flow of coagulation liquid to the central part of the perforated part worsened.

Reference Example 1

A fibrous bundle was obtained by performing spinning in the same way as Example 1, except for using the nozzle described in Table 1.

The spinning results thereof are shown in Table 1.

With Reference Example 1, although thread breakage of single fibers in the coagulation bath occurred, the quality of the fiber bundle was within a sufficiently usable range. The cause of this thread breakage is considered to be because, although the ejection hole area of the spinning nozzle was increased to facilitate ejection, in order to make the fineness match with the other examples, the draft ratio in the coagulation bath was raised.

Upon observing the obtained fiber bundle with a scanning electron microscope, fibers of nano-order level at 800 to 1,200 nm were observed.

Example 8

A spinning dope was prepared with 14.5% by mass polymer concentration by dissolving a polymer of 0.240 specific viscosity consisting of 96% by mass of acrylonitrile, 3% by mass of acrylamide, and 1% by mass of methacrylic acid in dimethylformamide (hereinafter DMAc), and then filtering with a sintered metal filter of 5 μm filtration accuracy. The viscosity thereof was 75 poise at 50° C. Next, a fibrous bundle with a single-fiber fineness of 0.055 dtex and total fineness of 5,850 dtex was obtained by performing spinning at the same conditions as Example 1, except for using the same nozzle as Example 7, and the dope ejection rate being set to $7.2\times10^{-5}$ cc/min per election hole Upon observing a cross-section of fibers, similarly to Example 1, favorable fibers were obtained without fibers adhering to each other.

The results thereof are shown in Table 1.

TABLE 1

| | Hole density Holes/mm$^2$ | Hole area μm$^2$ | Ejection hole diameter mmφ | Distance between outer edges of ejection holes μm | Perforated part width mm | Distance between perforated parts mm | Number of perforated parts Parts | Total number of holes $\times10^6$ holes | Dope A | Spinning property ○ |
|---|---|---|---|---|---|---|---|---|---|---|
| Example 1 | 1111 | 176.6 | 0.015 | 0.015 | 1 | 2 | 30 | 1.17 | A | ○ |
| Example 2 | 1111 | 176.6 | 0.015 | 0.015 | 2 | 2 | 23 | 1.75 | A | ○ |
| Example 3 | 1111 | 176.6 | 0.015 | 0.015 | 2 | 3 | 18 | 1.4 | A | ○ |
| Example 4 | 947 | 176.6 | 0.015 | 0.018 | 1 | 2 | 30 | 1.03 | A | ○ |
| Example 5 | 947 | 176.6 | 0.015 | 0.018 | 2 | 2 | 23 | 1.49 | A | ○ |
| Example 6 | 947 | 176.6 | 0.015 | 0.018 | 3 | 3 | 15 | 1.49 | A | Δ |
| Example 7 | 816 | 176.6 | 0.015 | 0.020 | 2 | 3 | 18 | 1.03 | A | ○ |
| Example 8 | 816 | 176.6 | 0.015 | 0.020 | 2 | 3 | 18 | 1.03 | B | ○ |
| Reference Example | 816 | 314.0 | 0.020 | 0.015 | 1 | 2 | 30 | 0.86 | A | ▲ |

Evaluation of the strength of the nanofibers produced in Example 4 was performed. Since measurement is not possible with single fibers, the measurement of the strength of the fibrous bundle was done as mentioned above, the unit-fineness converted strength was calculated and a comparison with fibers of 3.3 dtex was performed. The results thereof are shown in Table 2.

Example 9

Using the nozzle described in Example 4, coagulated fibers were introduced into hot water at 98° C. to remove DMAc similarly to Example 1, while performing drawing at 4.4 times, and a fibrous bundle was collected before the drying roll, without providing the oil solution.

Since the collected fibrous bundle was in a wet state, fibrous bundle that had been cut to about 2 m was placed into a constant temperature dryer kept at 100° C. to make to dry, thereby obtaining the fibrous bundle.

The dried fibrous bundle thus obtained had a total fineness of 10,006 dtex and a single-fiber fineness of 0.01 dtex.

The unit-fineness converted strength was measured. The results thereof are shown in Table 2

TABLE 2

| | Single-thread fineness dtex | Total fineness dtex | Number of times twisted Times/m | Measurement sample | Unit-fineness converted strength cN/dtex |
|---|---|---|---|---|---|
| Example 4 | 0.005 | 5003 | 15 | Fibrous mass | 5.11 |
| Example 9 | 0.010 | 10006 | 10 | Fibrous mass | 6.20 |
| Reference Example 1 | 3.3 | 1320 | 35 | Fibrous mass | 2.16 |

TABLE 2-continued

| | Single-thread fineness dtex | Total fineness dtex | Number of times twisted Times/m | Measurement sample | Unit-fineness converted strength cN/dtex |
|---|---|---|---|---|---|
| Reference Example 2 | 3.3 | — | — | Single fiber | 2.34 |

As shown in Table 2, the unit-fineness converted strength of the nanofiber produced in Example 4 was 5.11 cN/dtex, while the unit-fineness converted strength for a single-fiber fineness of 3.3 dtex measured in the same way was 2.16 cN/dtex, and thus is a unit-fineness converted strength higher than the strength of the single-fiber fineness of 3.3 dtex, and was a nanofiber having sufficient strength in handling.

For reference, upon comparing between the strength of Reference Example 1 obtained by calculating the unit-fineness converted strength from the strength of a fibrous bundle of 3.3 dtex and the strength of Reference Example 2 obtained by calculating the unit-fineness converted strength from the strength measured for a single fiber, they were roughly the same strengths.

Example 10

In the production process shown in Example 1, a fibrous bundle for which the oil solution concentration of the oil bath prior to drying and drawing was 5% by weight was used, and as the paper, a paper of 10 g/m$^2$ paper density (weight per area) that was a blend of 90% by weight short fibrous bundle having a single-fiber fineness of 0.005 dtex, and 10% by weight polyvinvlalcohol was used. It should be noted that fibers with a fiber length of 1 mm were used. The state regarding whether or not there was adherence between fibers of the paper thus manufactured was determined by SEM observation. In the SEM observation, a case of adherence of fibers being seen was defined as X, and the case of not being seen was defined as O.

The results thereof are shown in Table 3.

Example 11

Papermaking was done similarly to Example 10 to manufacture paper, except for using an oil solution differing from the oil solution used in Example 9. The state of the presence or absence of adhesion between fibers was determined by SEM observation. The results thereof are shown in Table 3.

Comparative Example 1

Paper making was done similarly to Example 10 to manufacture paper, except for the concentration of the oil solution used in Example 10 being 2% by weight. The state regarding the presence or absence of adhesion between fibers was determined by SEM observation. The results thereof are shown in Table 3.

Comparative Example 2

Papermaking was done to manufacture paper by using a fibrous bundle obtained by a similar production process as Example 2, except for the concentration of the oil solution used in Example 2 being 2% by weight. The state regarding the presence or absence of adhesion between fibers was determined by SEM observation.

TABLE 3

| | Type of oil solution | Oil solution concentration of oil-solution treatment liquid | Adherence of fibers during paper production |
|---|---|---|---|
| Example 10 | Cationic oil solution A | 5 | ○ |
| Example 11 | Cationic oil solution B | 5 | ○ |
| Comparative Example 1 | Cationic oil solution A | 2 | X |
| Comparative Example 2 | Cationic oil solution B | 2 | X |

Example 12

Paper was manufactured using the fibrous bundle manufactured by the production process of Example 1. As the paper, paper of 20 g/m$^2$ paper density (weight per area) that was a blend of 90% by weight of short fibrous bundle having a single-fiber density of 0.005 dtex and 10% by weight of polyvinylalcohol was used. It should be noted that fibers with a fiber length of 1 mm were used. The property evaluation results of this paper are shown in Table 4.

Furthermore, upon creating paper of low paper density (weight per area), 10 g/m$^2$ and 5 g/m$^2$ paper could be created; however, paper of 3 g/m$^2$ paper density (weight per area) could not be created.

Example 13

By the production process of Example 1, paper was manufactured using fibrous bundle prior to oil solution adhesion and drying and drawing. Paper was manufactured similarly to Example 12 except for using the short fibrous bundle prior to oil solution adhesion and prior to drying and drawing, having a single-fiber fineness of 0.010 dtex. The property evaluation results of this paper are shown in Table 4.

Furthermore, upon creating paper of low paper density (weight per area), 10 g/m$^2$, 5 g/m$^2$ and 3 g/m$^2$ paper could be created.

Comparative Example 3

Paper was manufactured using the fibrous bundle manufactured by the production process of Example 1. Paper was manufactured similarly to Example 12, except for using a short fibrous bundle having a single-fiber fineness of 0.100 dtex. The property evaluation results of this paper are shown in Table 4.

TABLE 4

| | Tensile strength N/mm$^2$ | Air permeance seconds |
|---|---|---|
| Example 12 | 3.7 | 0.3 |
| Example 13 | 10.5 | 0.5 |
| Comparative Example 3 | 2.8 | 0.03 |

When using the fibrous bundle according to the present invention, a paper density (weight per area) of the paper down to 3 g/m$^2$ was possible, and thus it was possible to manufacture paper that was thin and high strength. Furthermore, it is considered that, since it is finely woven and thus the air permeability is low, it is possible to develop practical uses in filter applications.

INDUSTRIAL APPLICABILITY

The super-porous nozzle of the present invention is manufactured by the electroforming method; therefore, the cost of nozzle creation is inexpensive. Since a maximum hole density of 1,110 holes/mm$^2$ or higher can be achieved within the current limitations, and due to establishing a structure to be inserted into conventional spinning nozzle components, it becomes possible to produce a continuous bundle of fibers of nano-order level by exploiting conventional spinning facilities without a large capital investment, in direct spinning without a drastic cost increase.

Since a lost-cost continuous bundle of fibers of nano-order level can be produced in large volumes by way of wet-direct spinning in this way, it can be utilized also in a further grade-up of suede-tone artificial leather, IT associated industry components like high-performance non-woven fabrics and industrial material applications like high-performance filters. In addition, there is also a possibility of development in secondary battery separators equipped to hybrid vehicles and electric cars, if converting into carbon fibers by calcining the nonwoven fabric obtained in the present invention.

In particular, in the case of using undried, wet fibers obtained in the middle of the production of the nanofibers of the present invention as is, since the number of fibers increases when the fiber diameter is very small, the interlacing property is very high and can be made into non-woven fabric as is, and thus by cutting to shorten to the appropriate length, dispersing into water, and then papermaking, it is possible to make into a non-woven fabric. For the non-woven fabric that can be made, a non-woven fabric excelling in adsorption property is obtained due to the porous structure thereof and the single-fiber diameter being very small.

EXPLANATION OF REFERENCE NUMERALS

1 spinning nozzle
2 perforated part
3 election hole
4 non-perforated part
W1 perforated part width
W2 lane width
P1 pitch between ejection holes
L1 ejection hole outer edge inter-distance (a) Length of long side of perforated part group (b) Length of short side of perforated part group

The invention claimed is:

1. A fibrous bundle, comprising:

a plurality of fibers having a single-fiber fineness of at least 0.005 dtex to no more than 0.01 dtex, wherein the fibrous bundle has a total fineness of at least $4\times10^3$ dtex to no more than $8\times10^5$ dtex, the fibers in the fibrous bundle are acrylic fibers, the fibrous bundle comprises a long fibrous bundle comprising the fibers and having a length of more than 200 mm, and the fibers in the long fibrous bundle consist of a single material.

2. A fibrous bundle, comprising:

a plurality of fibers having a single-fiber fineness of at least 0.005 dtex to no more than 0.01 dtex, wherein the fibrous bundle has a total fineness of at least $4\times10^3$ dtex to no more than $8\times10^5$ dtex, the fibrous bundle has a single fiber converted strength of at least 5.0 cN/dtex to no more than 7.0 cN/dtex, the fibrous bundle comprises a long fibrous bundle comprising the fibers and having a length of more than 200 mm, and the fibers in the long fibrous bundle consist of a single material.

3. A paper, comprising:

at least 80% by mass to no more than 85% by mass of a plurality of fibers having a single-fiber fineness of at least 0.005 dtex to no more than 0.01 dtex, the fibers comprising at least one selected from the group consisting of cellulose, cellulose acetate, a cellulose derivative other than cellulose acetate, and a polyacrylonitrile-based polymer, wherein the fibers have a length of at least 3 mm to no more than 10 mm, and the paper has a density of at least 3 $g/m^2$ to no more than 30 $g/m^2$.

4. The paper according to claim 3, having:

a tensile strength, in a length direction having a paper width of 15 mm, of at least 3.0 $N/mm^2$ to no more than 13.5 $N/mm^2$, and an air permeance at least 0.1 seconds to no more than 1.0 second.

5. The paper according to claim 3, wherein the fibers comprise at least one selected from the group consisting of cellulose and cellulose acetate.

6. The paper according to claim 3, wherein the paper has a density of at least 3 $g/m^2$ to no more than 8 $g/m^2$.

7. A long fibrous bundle, consisting of:

a plurality of acrylic fibers having a single-fiber fineness of at least 0.005 dtex to no more than 0.01 dtex, wherein the long fibrous bundle has a total fineness of at least $4\times10^3$ dtex to no more than $8\times10^5$ dtex and a length of more than 200 mm.

8. A fibrous bundle, comprising:

the long fibrous bundle of claim 7; and a short fibrous bundle having a length of 1 mm or more and 200 mm or less and comprising a plurality of fibers having a single-fiber fineness of at least 0.005 dtex to no more than 0.01 dtex.

* * * * *